US012264477B2

(12) United States Patent
Hong et al.

(10) Patent No.: US 12,264,477 B2
(45) Date of Patent: Apr. 1, 2025

(54) LOUVER CANOPY ADOPTING A FASTENER-FREE QUICK-MOUNTING STRUCTURE

(71) Applicant: Yotrio Group Co., Ltd., Linhai (CN)

(72) Inventors: Bo Hong, Linhai (CN); Jianqiang Xie, Linhai (CN)

(73) Assignee: Yotrio Group Co., Ltd., Linhai (CN)

( * ) Notice: Subject to any disclaimer, the term of this patent is extended or adjusted under 35 U.S.C. 154(b) by 158 days.

(21) Appl. No.: 18/141,467

(22) Filed: May 1, 2023

(65) Prior Publication Data

US 2023/0417060 A1 Dec. 28, 2023

(30) Foreign Application Priority Data

Jun. 24, 2022 (CN) ..... 202221593429.2

(51) Int. Cl.
*E04F 10/10* (2006.01)

(52) U.S. Cl.
CPC ..... *E04F 10/10* (2013.01)

(58) Field of Classification Search
CPC ..... E04F 10/10; E04B 7/163
See application file for complete search history.

(56) References Cited

U.S. PATENT DOCUMENTS 3,219,101 A * 11/1965 Prehn ..... E04F 10/10 160/206
2018/0202155 A1* 7/2018 Abeel ..... E04B 1/388
2019/0338528 A1* 11/2019 Torman ..... E04F 10/10
2021/0332587 A1* 10/2021 Geriavenko ..... E04F 10/10
2021/0363752 A1* 11/2021 Wagaman ..... E04F 10/10
2023/0358053 A1* 11/2023 Fang ..... E04F 10/10
2023/0392381 A1* 12/2023 Brabant ..... E04F 10/10

FOREIGN PATENT DOCUMENTS

CN 110565991 A * 12/2019 ..... E04F 10/10

* cited by examiner

*Primary Examiner* — Beth A Stephan
(74) *Attorney, Agent, or Firm* — Jingming (James) Cai; SAC Attorneys LLP

(57) ABSTRACT

A louver canopy adopting a fastener-free, quick-mounting structure is provided. The louver canopy includes multiple louver boards, a ring beam frame, and rotating shafts. The ring beam frame is positioned around a periphery of the louver boards. The ring beam frame includes first ring beams and second ring beams. The first ring beams are matched with the louver boards for mounting the louver boards. The second ring beams connect the first ring beams on two sides. Each first ring beam includes open slots along its length. The rotating shafts are fixedly arranged at two ends of each louver board. Each rotating shaft is installed in a corresponding open slot of a corresponding first ring beam through a clamp sleeve assembly, such that each louver board is rotatably matched with corresponding open slots of the first ring beams and is disengageable from open ends of the corresponding open slots.

9 Claims, 7 Drawing Sheets

LOUVER CANOPY ADOPTING A FASTENER-FREE QUICK-MOUNTING STRUCTURE

CROSS-REFERENCE TO RELATED APPLICATIONS

This application claims priority to and the benefit of the patent application titled "A louver canopy adopting a fastener-free quick-mounting structure", application number 202221593429.2, filed in the China National Intellectual Property Administration on Jun. 24, 2022. The specification of the above-referenced patent application is incorporated herein by reference in its entirety.

FIELD OF THE INVENTION

The present invention, in general, relates to outdoor awnings, and in particular, relates to a louver canopy adopting a fastener-free, quick-mounting structure.

BACKGROUND

There are outdoor tents of various structures, which can be used as folding tents for folding and storage and also as fixed tents that are directly placed in outdoor courtyards and parks. As a fixed canopy, a louver canopy adopts a louver structure on the top surface. The louver structure can be turned over by a linkage mechanism to realize its function as a sunshade or an opening. Louver canopies are typically used for adjusting light.

The canopy structure in existing louver awnings is constructed by louver boards and ring beams as disclosed in Chinese patent publication number CN110565991A. CN110565991 A discloses an outdoor electric louver awning. As shown in FIG. 4 and FIG. 5 of Chinese patent publication number CN110565991A, a first shaft sleeve is fixed on a first end plate of an active louver through a specially customized stepped screw, where the specially customized stepped screw effectively positions and ensures a smooth rotation of the first shaft sleeve. The outdoor electric louver awning of Chinese patent publication number CN110565991A includes a louver transmission member configured as a louver transmission knife, where one end of the louver transmission knife is connected to an output end of an electric drive device, and the other end of the louver transmission knife is provided with a through hole. Correspondingly, a center position of a second end plate of the active louver is provided with a hinge hole which is adapted to the through hole of the louver transmission knife. The other end of the louver transmission knife is connected to the second end plate of the active louver based on a cooperation between a first connecting piece with the through hole of the louver transmission knife and the hinge hole of the second end plate of the active louver. The first connecting piece includes connecting parts such as bolts, screws, etc. The louver transmission knife moves under a drive of the electric drive device, and drives the active louver to rotate.

The above-mentioned outdoor electric louver awning uses pin shafts or bolts to define an axis, matches the rotating part, and fixes the rotating part to the louver board through a fastener, to realize a fixed installation. However, in the process of fixing the louvers and the ring beams, the operation of fastening screws is relatively cumbersome, which increases the production cost of the initial product. Furthermore, in a later maintenance process, if there are individual louver blades that need to be replaced, the process of disassembling and assembling the louver awning is troublesome.

SUMMARY OF THE INVENTION

To address the above-mentioned problems, the present invention discloses a louver canopy adopting a fastener-free, quick-mounting structure, which adopts a snap-in installation structure design so that louver boards can be quickly installed to ring beams, which improves assembly efficiency, and at the same time, provides convenience for later maintenance.

The louver canopy adopts a fastener-free, quick-mounting structure. The louver canopy comprises a plurality of louver boards, a ring beam frame, and rotating shafts. The ring beam frame is positioned around a periphery of the louver boards. The ring beam frame comprises first ring beams and second ring beams. The first ring beams are matched with the louver boards for mounting the louver boards. The second ring beams are configured to connect the first ring beams on two sides of the first ring beams. Each of the first ring beams is provided with a plurality of open slots along a length of each first ring beam. The rotating shafts are fixedly arranged at two ends of each of the louver boards. Each of the rotating shafts is installed in a corresponding one of the open slots of a corresponding one of the first ring beams through a clamp sleeve assembly, such that each of the louver boards is rotatably matched with corresponding open slots of the first ring beams and are disengageable from open ends of the corresponding open slots.

An upper part of each of the open slots in each of the first ring beams is provided with an open end. An inner diameter of the open end at an end surface is gradually increased in a downward direction until a maximum outer diameter of the open slot is reached.

Each open slot is a round hole with an opening structure. An outer diameter of the open end of each open slot is smaller than a diameter of the round hole.

The clamp sleeve assembly includes a clamp sleeve sleeved on each of the rotating shafts. The clamp sleeve includes a first wheel shaft, a second wheel shaft, a third wheel shaft, and a fourth wheel shaft arranged in sequence. An outer diameter of the first wheel shaft is greater than a maximum outer diameter of each open slot. The second wheel shaft, the third wheel shaft, and the fourth wheel shaft are configured to pass through each open slot.

An outer diameter of the third wheel shaft is smaller than outer diameters of the first wheel shaft, the second wheel shaft, and the fourth wheel shaft. An outer diameter of the first wheel shaft is larger than the outer diameter of the second wheel shaft and the fourth wheel shaft. The second wheel shaft, the third wheel shaft, and the fourth wheel shaft mutually form an annular groove cavity.

The second wheel shaft is configured to cooperate with each open slot. The clamp sleeve assembly also includes a clamping piece configured to cooperate with the annular groove cavity. One side of the clamping piece is configured to form a limit with a first side wall of each open slot. A side wall of the first wheel shaft facing the second wheel shaft is configured to form a limit with a second side wall of each open slot.

The clamping piece is an elastic snap ring.

An outer diameter of each rotating shaft is smaller than the inner diameter of the open end of each open slot.

Each of the first ring beams includes a ring beam body, a clamping part, and a drainage part. The clamping part is located on one side of the ring beam body. The clamping part includes a bottom plate and a vertical plate. The open slots are arranged on the vertical plate. The drainage part is located below the clamping part. The drainage part includes a drainage groove plate and a drainage baffle. A width of the drainage groove plate is greater than a width of the bottom plate of the clamping part. The drainage baffle is located inwardly from an outer edge of each of the louver boards.

The bottom plate and the vertical plate of the clamping part are arranged in a horizontal "L" shape. The drainage groove plate and the drainage baffle of the drainage part are arranged in a horizontal "L" shape.

The louver canopy disclosed herein adopts a clamping installation structure through an optimized design, where the clamp sleeve assembly provides a lateral limit with the open slot, and at the same time, allows convenient rotation of each louver board, facilitates a coordinated installation of the louver boards and the ring beams, reduces the assembly cost, and facilitates maintenance and replacement of the louver boards in later stages.

To understand the characteristics of the present invention, refer to the drawings and the following detailed description.

Figure 1:
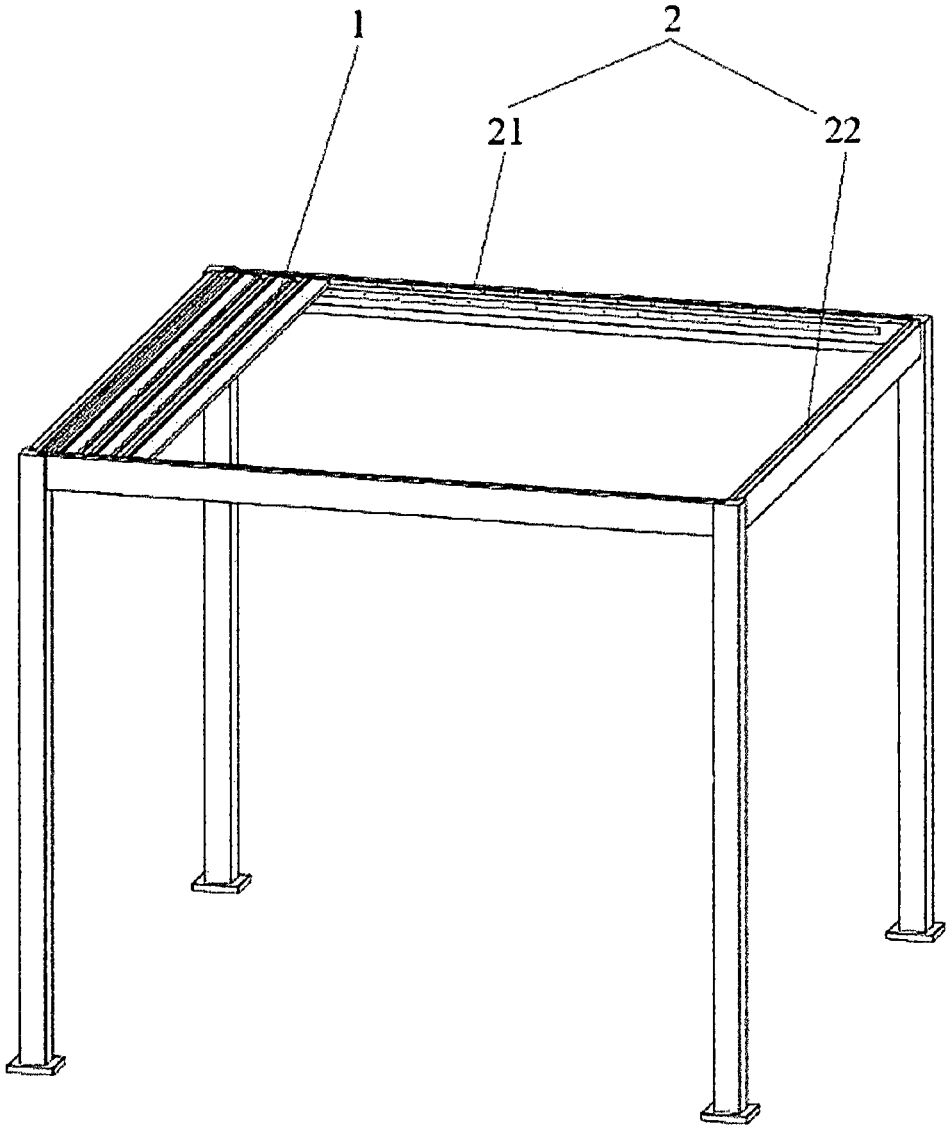
FIG. 1 is a structural diagram of a louver canopy adopting a fastener-free, quick-mounting structure.

In the figures, 100. Louver canopy; 1. Louver board; 11 Rotating shaft; 2. Ring beam frame; 21. First ring beam; 22. Second ring beam; 23. Open slot; 231. Open end; 24. Ring beam body; 25. Clamping part; 251. Bottom plate; 252. Vertical plate; 26. Drainage part; 261; Drainage groove plate; 262. Drainage baffle; 3. Clamp sleeve assembly; 31. Clamp sleeve; 311; First wheel shaft; 312. Second wheel shaft; 313. Third wheel shaft; 314. Fourth wheel shaft; 315. Annular groove cavity; and 32. Clamping piece; 101 *a* One end of the Louver board 1; 101 *b* Other end of the Louver board 1; 101 *c* Outer edge of the Louver board 1; 23 *a* Open slots on the Vertical Plate 252; 31 *a* Center hole in the Clamp Sleeve 31; 32*a* One side of the Clamping Piece 32; 252 *a* Second side wall 252 *a* of the Open Slot 23; 252 *b* Side wall 252 *b* of the Vertical Plate 252, which is also the First side wall of the Open Slot 23; 311 *a* Side wall of the Wheel Shaft 311.

DETAILED DESCRIPTION OF THE INVENTION

To make the technical means, creative features, purposes achieved, and effects of the present invention easy to understand, the following is a further elaboration of the present invention combined with specific implementation methods.

It should be noted that all the directional references (such as up, down, left, right, front, back, etc. in the embodiments of the present invention are only used for explaining relative position relationships, movement conditions, and the like, between all parts under a particular perspective (shown in the drawings), and when the particular perspective changes, the directional references also correspondingly change accordingly. In addition, the terms "first", "second", etc., disclosed in the present invention are only used for descriptive purposes, and cannot be interpreted to indicate or imply relative importance or implicitly indicate a number of the indicated technical features. Thus, features defined as "first" and "second" may explicitly or implicitly comprise at least one feature.

Disclosed herein is a louver canopy 100 adopting a fastener-free, quick-mounting structure as shown in FIG. 1. The louver canopy 100 comprises a plurality of louver boards 1, a ring beam frame 2, and rotating shafts 11 as shown in FIG. 1 to FIG. 11. The ring beam frame 2 is positioned around a periphery of the louver boards 1. The ring beam frame 2 comprises first ring beams 21 and second ring beams 22. The first ring beams 21 are matched with the louver boards 1 for mounting, the louver boards 1. The second ring beams 22 are configured to connect the first ring beams 21 on two sides of the first ring beams 21. In an embodiment, the ring beam frame 2 is a single rectangular frame structure, where the first ring beams 21 and the second ring beams 22 form a rectangular frame. The first ring beams 21 define the long sides of the ring beam frame 2, and the second ring beams 22 define the short sides of the ring beam frame 2. In other embodiments, the ring beam frame 2 is a configured as a multi-framed structure, such as a "digital number eight"-shaped frame, a "目 (Chinese character)"-shaped frame, etc., where the positions of the louver boards 1 and the first ring beams 21 are arranged according to product specifications. Each of the first ring beams 21 is provided with a plurality of open slots 23 along a length of each first ring beam 21 as shown in FIG. 10.

Figure 2:
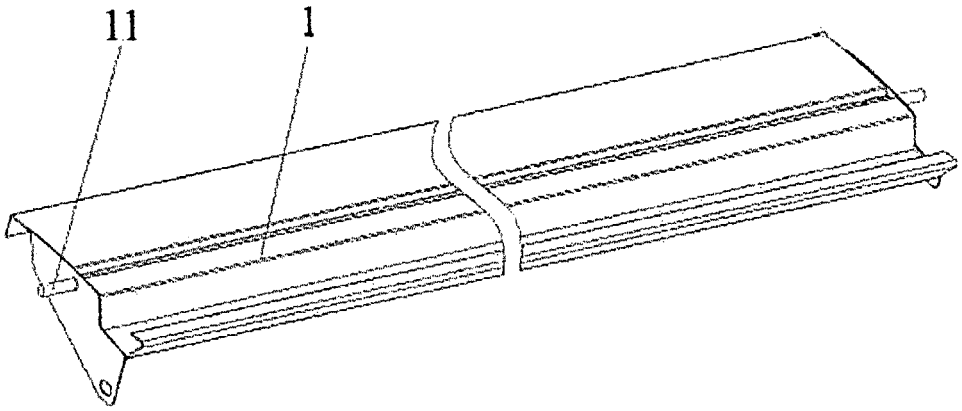
FIG. 2 is a structural diagram of a louver board of the louver canopy.
Figure 3:
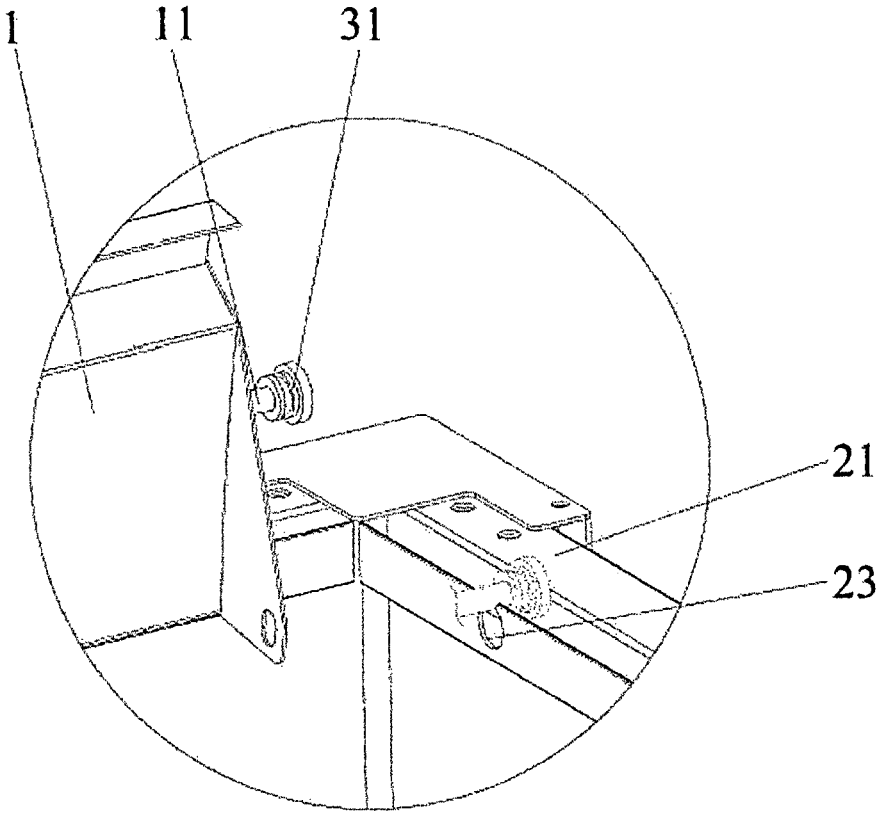
FIG. 3 is a structural diagram showing installation of the louver board to a first ring beam of the louver canopy.
Figure 4:
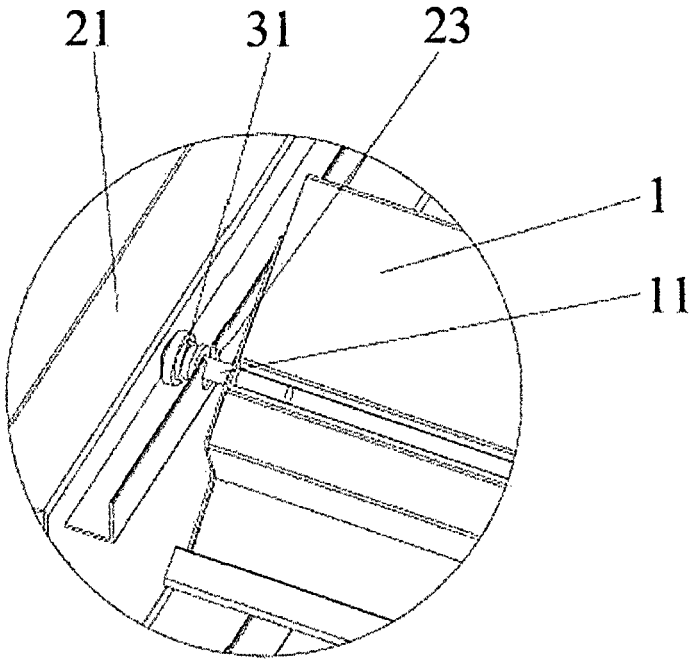
FIG. 4 is a structural diagram showing the louver board installed to the first ring beam of the louver canopy.
Figure 5:
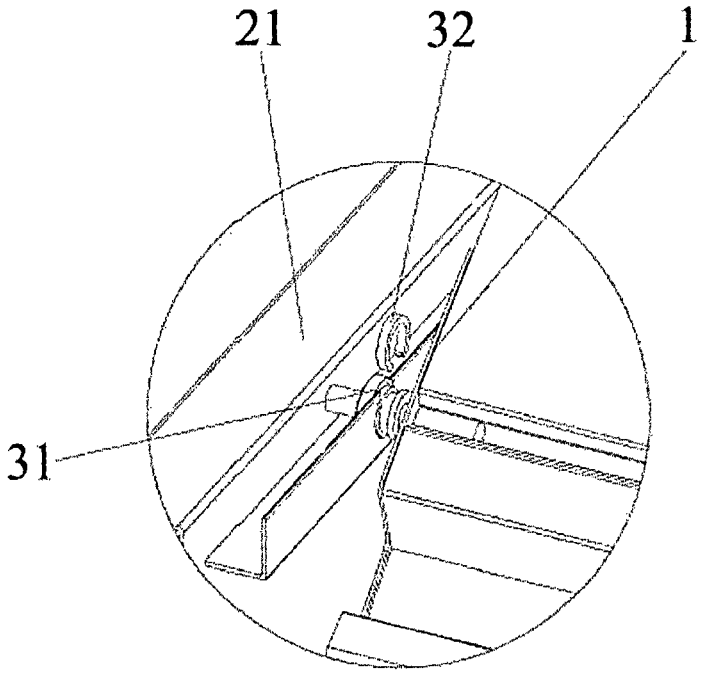
FIG. 5 is another structural diagram of the louver board installed to the first ring beam of the louver canopy, showing a clamping piece of a clamp sleeve assembly.
Figure 6:
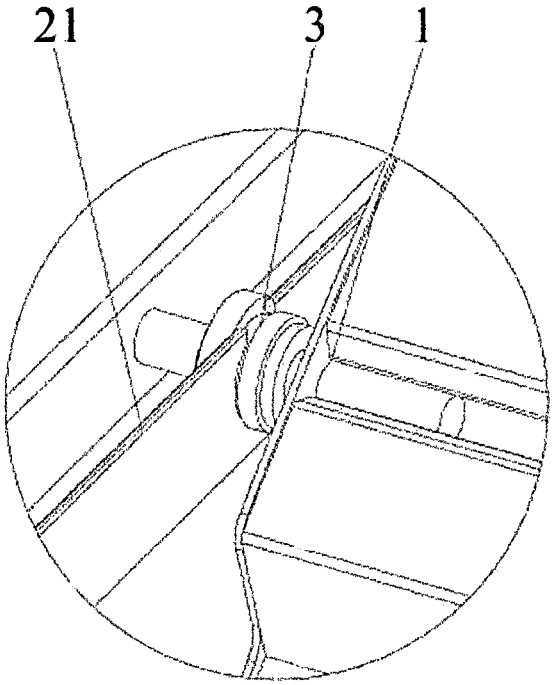
FIG. 6 is an enlarged view showing the louver board installed to the first ring beam of the louver canopy.
Figure 7:
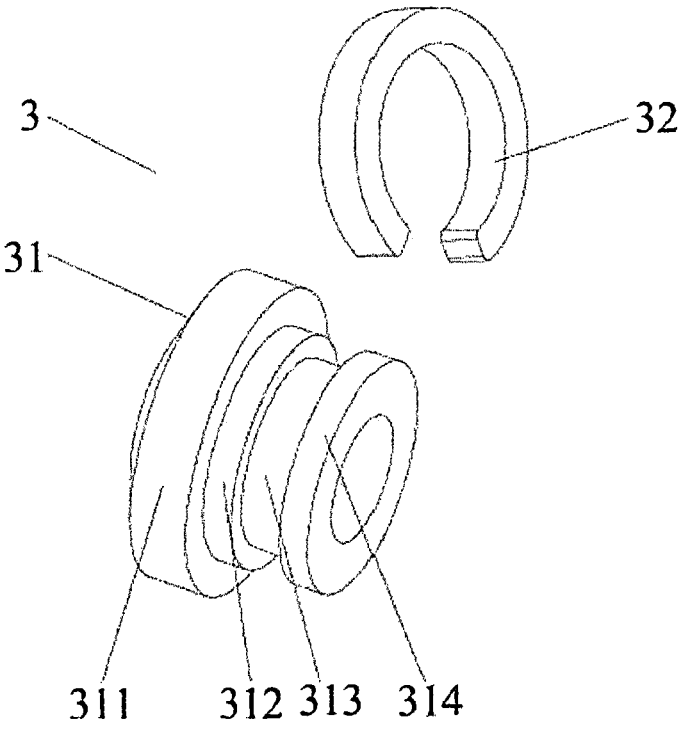
FIG. 7 is a structural diagram of a clamp sleeve assembly of the louver canopy.

The rotating shafts 11 are fixedly arranged at two ends 101*a* and 101*b* of each louver board 1 as shown in FIG. 2. Each rotating shaft 11 is installed in a corresponding one of the open slots 23 of a corresponding one of the first ring beams 21 through a clamp sleeve assembly 3 as shown in FIGS. 3-6, so that each louver board 1 is rotatable matched with the corresponding open slots 23 of the first ring beams 21 and cannot be disengaged from open ends 231 of the open slots 23. By optimizing the structure of the clamp sleeve assembly 3 as shown in FIGS. 5-7, the installation of the louver board 1 and the first ring beams 21 does not need to be tightened by fasteners such as bolts or screws. After each rotating shaft 11 of each louver board 1 is installed into the corresponding open slot 23 through the clamp sleeve assembly 3, the clamp sleeve assembly 3 is used as the center point of each rotating shaft 11. Each louver board 1 is pulled or pushed by an external force to realize rotation of the louver board 1 and to open and close the louver board 1.

An upper part of each open slot 23 in each first ring beam 21 is provided with an open end 231 as shown in FIGS. 3-4, FIG. 6, and FIGS. 10-11. An inner diameter at an end surface of the open end 231 gradually increases downwards until a maximum outer diameter of each open slot 23 is reached. In an embodiment, each open slot 23 is a round hole with an opening structure. An outer diameter of the open end 231 of each open slot 23 is smaller than a diameter of the round hole. In other embodiments, each open slot 23 is a U-shaped hole with a reducing structure, an elliptic hole with an opening, and the like.

Figure 8:
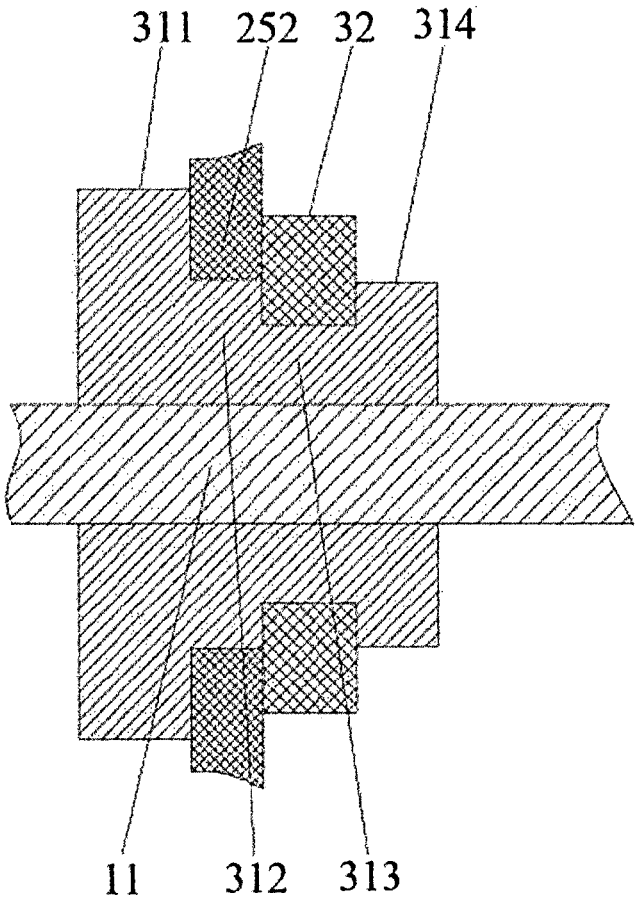
FIG. 8 is a sectional view of the clamp sleeve assembly and the rotating shaft of the louver canopy.
Figure 9:
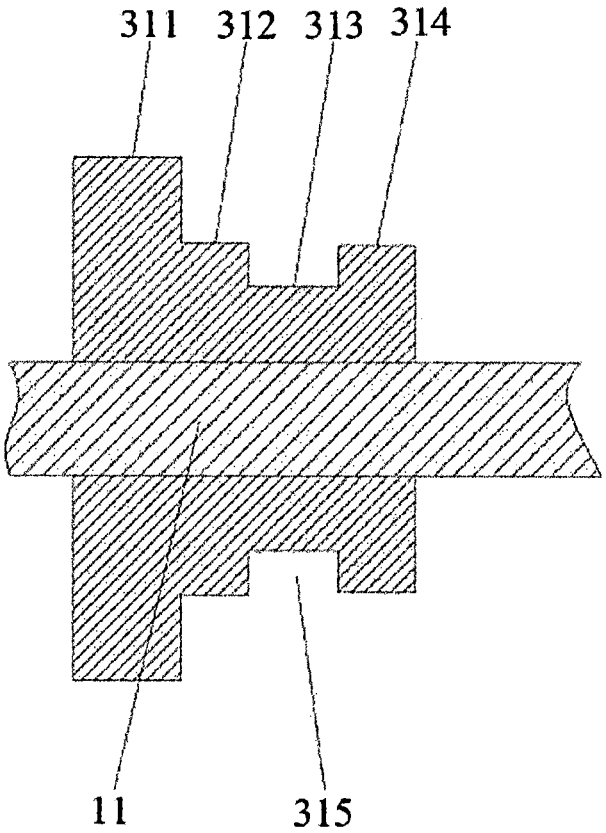
FIG. 9 is another sectional view of the clamp sleeve assembly and the rotating shaft of the louver canopy.
Figure 10:
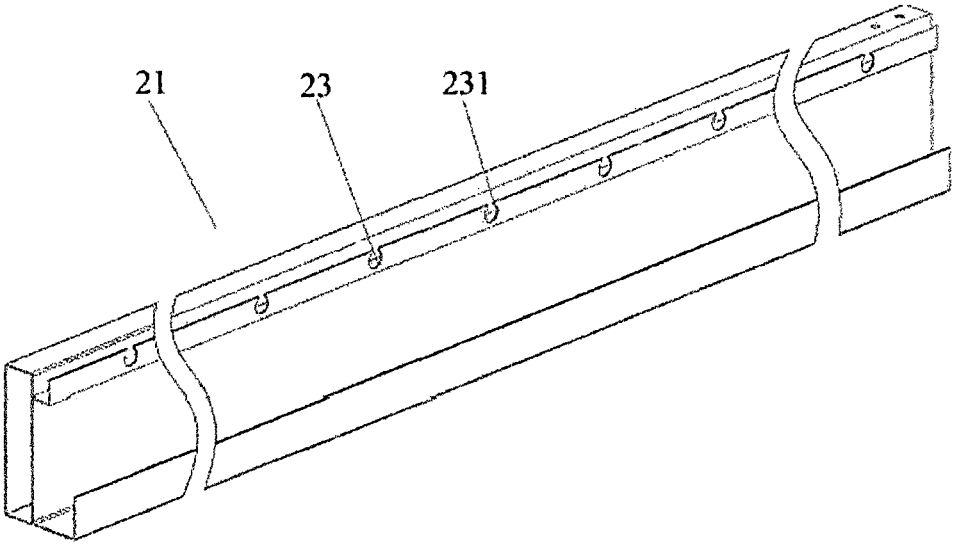
FIG. 10 is a structural diagram of the first ring beam of the louver canopy.

As shown in FIG. 7, FIG. 8, and FIG. 9, the clamp sleeve assembly 3 includes a clamp sleeve 31, which is sleeved on each rotating shaft 11. The outer diameter of each rotating shaft 11 is smaller than the inner diameter of the open end 231 of each open slot 23. The clamp sleeve 31 includes a first wheel shaft 311, a second wheel shaft 312, a third wheel shaft 313, and a fourth wheel shaft 314 arranged in sequence as shown in FIGS. 7-9. The outer diameter of the first wheel shaft 311 is greater than the maximum outer diameter of each open slot 23. The second wheel shaft 312, the third wheel shaft 313, and the fourth wheel shaft 314 are configured to pass through each open slot 23. The outer diameter of the second wheel shaft 312 is larger than the inner diameter of the open end 231, so that the second wheel shaft 312 cannot be disengaged from the open slot 23 after assembly.

In addition, the outer diameter of the third wheel shaft 313 is smaller than the outer diameters of the first wheel shaft 311, the second wheel shaft 312, and the fourth wheel shaft 314. The outer diameter of the first wheel shaft 311 is larger than the outer diameters of the second wheel shaft 312 and the fourth wheel shaft 314. The second wheel shaft 312, the third wheel shaft 313, and the fourth wheel shaft 314 mutually form an annular groove cavity 315 as shown in FIG. 9. The second wheel shaft 312 is configured to cooperate with each open slot 23. The clamp sleeve assembly 3 also includes a clamping piece 32 as shown in FIGS. 5-8. The clamping piece 32 is configured to cooperate with the annular groove cavity 315 as shown in FIGS. 8-9. One side 32*a* of the clamping piece 32 shown in FIG. 7, is used to form a limit with a first side wall of each open slot 23. The first side wall of each open slot 23 is a side wall 252*b* of a vertical plate 252 of each first ring beam 21 shown in FIG. 6, FIG. 8, and FIG. 11. As shown in FIG. 8, a side wall 311*a* of the first wheel shaft 311 opposite to or facing the second wheel shaft 312 forms a limit with a second side wall 252*a* of the open slot 23, specifically the position of the side wall part of the vertical plate 252 close to the open slot 23. In an embodiment, the clamping piece 32 is an elastic snap ring.

To assemble the louver canopy 100, the clamp sleeve 31 and the rotating shaft 11 are first fitted on each louver board 1, wherein the axial length of the rotating shaft 11 is greater than the axial length of the clamp sleeve 31. The rotating shaft 11 runs through a center hole 31*a* in the clamp sleeve 31 shown in FIG. 7. In an embodiment, the clamp sleeve 31 and the rotating shaft 11 are in a fixed arrangement, where the clamp sleeve 31 and the rotating shaft 11 are fitted by a thread fit installation, a spline fit installation, a round shaft interference fit installation, etc. In another embodiment, the clamp sleeve 31 and the rotating shaft 11 are arranged in a sliding fit arrangement, where the clamping piece 32 is connected to the first wheel shaft 311 to realize the limit and fixation on both sides of the open slot 23. After fitting the clamp sleeve 31 and the rotating shaft 11, the clamp sleeve 31 is generally located relative to the outer side of the rotating shall 11. The rotating shaft 11 between the clamp sleeve 31 and the end 101*a* or 101*b* of the louver board 1 shown in FIG. 2, is inserted into an inner cavity 23*a* of the open slot 23 through the open end 231 as shown in FIGS. 3-4, and then the fourth wheel shaft 314 and the third wheel shaft 313 of the clamp sleeve 31 both penetrate inwardly from the open slot 23 by moving therethrough, so that the second wheel shaft 312 is positioned in the open slot 23 as shown in FIGS. 5-6 and FIG. 8. While the inner wall surface 311*a* of the first wheel shall 311 realizes the position limit, the third wheel shaft 313 and the fourth wheel shaft 314 are located on an inner side of the open slot 23 as shown in FIGS. 5-6 and FIG. 8. The clamping piece 32 is clamped in the annular groove cavity 315 as shown in FIGS. 8-9, so that the clamping piece 32 restricts movement on the inner side wall of the open slot 23, thereby completing the installation of the louver board 1 to the first ting beams 21.

Figure 11:
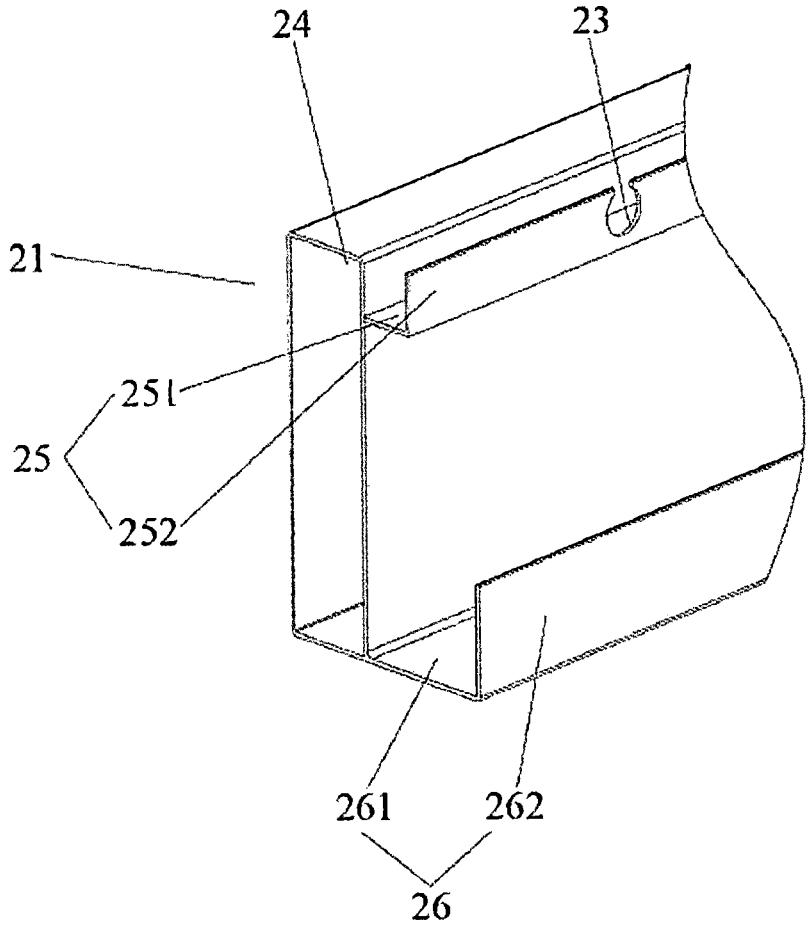
FIG. 11 is another structural diagram of the first ring beam of the louver canopy.

In an embodiment, each first ring beam 21 includes a ring beam body 24, a clamping part 25, and a drainage part 26 as shown in FIGS. 10-11. The clamping part 25 is disposed on one side of the ring beam body 24. The clamping part 25 includes a bottom plate 251 and a vertical plate 252. The bottom plate 251 and the vertical plate 252 are arranged in a horizontal "L" shape. The open slots 23 are arranged on the vertical plate 252 as shown in FIG. 10. The drainage part 26 is located below the clamping part 25. The drainage part 26 includes a drainage groove plate 261 and a drainage baffle 262. The drainage groove plate 261 and the drainage baffle 262 are arranged in a horizontal "L" shape. The width of the drainage groove plate 261 is greater than the width of the bottom plate 251 of the clamping part 25. The drainage baffle 262 is located at an inward position of an outer edge 101 *c* of the louver board 1. To optimize the structural design, an extended drainage part structure is adopted, so that an end surface of the louver board 1 is directly located in the drainage part 26, which facilitates the drainage of the louver board 1.

The louver canopy 100 disclosed herein adopts a clamping installation structure through an optimized design, where the clamp sleeve assembly 3 provides a lateral limit with the open slot 23, and at the same time, allows convenient rotation of each louver board 1, facilitates a coordinated installation of the louver boards 1 and the ring beams 21 and 22, reduces the assembly cost, and facilitates maintenance and replacement of the louver boards 1 in later stages.

The above is only an embodiment of the present invention and does not limit the present invention in any form. Any revisions, equivalent changes, or modifications made to the above embodiments according to the technical principle of the present invention, belong to the scope of the technical scheme of the present invention.

We claim:

1. A louver canopy adopting a quick-mounting structure, the louver canopy comprising:

a plurality of louver boards;

a ring beam frame positioned around a periphery of the plurality of louver boards, wherein the ring beam frame comprises first ring beams and second ring beams, wherein the first ring beams are matched with the louver boards for mounting the louver boards, wherein the second ring beams are configured to connect the first ring beams on two sides of the first ring beams, and wherein each of the first ring beams is provided with a plurality of open slots along a length of each of the first ring beams; and rotating shafts fixedly arranged at two ends of each of the louver boards, wherein each rotating shaft is installed in a corresponding one of the open slots of a corresponding one of the first ring beams through a clamp sleeve assembly, wherein each of the louver boards is rotatably matched with corresponding one of the open slots of the first ring beams and is disengageable from open ends of the corresponding open slots, wherein the clamp sleeve assembly comprises a clamp sleeve sleeved on each of the rotating shafts, wherein the clamp sleeve includes a first wheel shaft, a second wheel shaft, a third wheel shaft, and a fourth wheel shaft arranged in sequence, wherein an outer diameter of the first wheel shaft is greater than a maximum outer diameter of each of the open slots, and wherein the second wheel shaft, the third wheel shaft, and the fourth wheel shaft are configured to pass through each of the open slots.

2. The louver canopy according to claim 1, wherein an upper part of each of the open slots in each of the first ring beams is provided with the open end, and wherein an inner diameter at an end surface of the open end is gradually increased in a downward direction until a maximum outer diameter of each of the open slots is reached.

3. The louver canopy according to claim 2, wherein each of the open slots is a round hole with an opening structure, and wherein an outer diameter of the open end of each of the open slots is smaller than a diameter of the round hole.

4. The louver canopy according to claim 2, wherein an outer diameter of each of the rotating shafts is smaller than the inner diameter of the open end of each of the open slots.

5. The louver canopy according to claim 1, wherein an outer diameter of the third wheel shaft is smaller than the outer diameter of the first wheel shaft, an outer diameter of the second wheel shaft, and an outer diameter of the fourth wheel shaft, wherein the outer diameter of the first wheel shaft is larger than the outer diameter of the second wheel shaft and the fourth wheel shaft, and wherein the second wheel shaft, the third wheel shaft, and the fourth wheel shaft mutually form an annular groove cavity.

6. The louver canopy according to claim 5, wherein the second wheel shaft is configured to cooperate with each of the open slots, wherein the clamp sleeve assembly includes a clamping piece configured to cooperate with the annular groove cavity, wherein one side of the clamping piece is configured to form a limit with a first side wall of each of the open slots, and wherein a side wall of the first wheel shaft facing the second wheel shaft is configured to form a limit with a second side wall of each of the open slots.

7. The louver canopy according to claim 6, wherein the clamping piece is an elastic snap ring.

8. The louver canopy according to claim 1, wherein each first ring beam comprises:

a ring beam body;

a clamping part located on one side of the ring beam body, wherein the clamping part includes a bottom plate and a vertical plate, and wherein the open slots are arranged on the vertical plate; and a drainage part located below the clamping part, wherein the drainage part includes a drainage groove plate and a drainage baffle, wherein a width of the drainage groove plate is greater than a width of the bottom plate of the clamping part, and wherein the drainage baffle is located at an inward position of an outer edge of each of the louver boards.

9. The louver canopy according to claim 8, wherein the bottom plate and the vertical plate of the clamping part are arranged in a horizontal "L" shape, and wherein the drainage groove plate and the drainage baffle of the drainage part are arranged in a horizontal "L" shape.

* * * * *